US006361633B1

(12) United States Patent
Böhm et al.

(10) Patent No.: US 6,361,633 B1
(45) Date of Patent: Mar. 26, 2002

(54) METHOD FOR PRODUCING A TWO CHAMBER PRESSURE PACK

(75) Inventors: Konrad Böhm, Volkertshausen; Norbert Achten, Ohringen, both of (DE)

(73) Assignee: Lechner GmbH, Rielasingen (DE)

( * ) Notice: Subject to any disclaimer, the term of this patent is extended or adjusted under 35 U.S.C. 154(b) by 0 days.

(21) Appl. No.: 09/331,627

(22) PCT Filed: Oct. 19, 1998

(86) PCT No.: PCT/DE98/03058

§ 371 Date: Jul. 6, 1999

§ 102(e) Date: Jul. 6, 1999

(87) PCT Pub. No.: WO99/20413

PCT Pub. Date: Apr. 29, 1999

(30) Foreign Application Priority Data

Oct. 17, 1997 (DE) ..... 197 46 017

(51) Int. Cl.[7] ..... B65D 90/04

(52) U.S. Cl. ..... 156/69; 220/62.21; 220/291

(58) Field of Search ..... 156/69, 291; 53/469, 53/470, 471; 413/1; 220/495.06, 62.21, 677, 678; 29/505, 522.1, 523

(56) References Cited

U.S. PATENT DOCUMENTS 3,432,916 A * 3/1969 Fisher et al. ..... 29/516
5,069,590 A * 12/1991 Stoffel ..... 413/1
5,315,811 A * 5/1994 Biesecker et al. ..... 53/474

* cited by examiner

*Primary Examiner*—Sam Chuan Yao
*Assistant Examiner*—Jessica Rossi
(74) *Attorney, Agent, or Firm*—Max Fogiel

(57) ABSTRACT

A method and device for producing a two chamber pressure pack comprised of an outer container (1) and an inner sack (2) which are glued in an edge area. After inserting the inner sack into the outer container, the edge area of the inner sack is expanded by means of a tool, said tool being guided into said area, and is pressed against the inner surface of the edge area of the outer container. Afterwards, the edge areas which are connected to one another are mutually bordered by the outer container and inner sack. A valve cover is placed on the bordering edge in a sealed manner. In order to be able to uniformly expand the edge area of the inner sack, a compressible elastic body (5) is used as a tool, said body being arranged approximately vertical in relation to the opening plane. When the inner sack is being inserted into the outer container, the outer periphery of said body is smaller than that of the inner wall of the inner sack edge area. Subsequently, when compression is increased, the outer surface of the edge area of the inner sack is placed on and presses against the inner surface of the outer container as a result of the fact that the outer periphery of the elastic body continually increases in a radial uniform manner in such a way that the outer surface is fully pressed against the inner wall of the edge area of the inner sack, and the peripheral surface formed by the inner wall regularly increases.

5 Claims, 1 Drawing Sheet

1
2
11
10
11
8
7
5
12
3
6
9
4
14
13
d
Q
d1
Q1

METHOD FOR PRODUCING A TWO CHAMBER PRESSURE PACK

BACKGROUND OF THE INVENTION

The present invention concerns a method of manufacturing a pressurized two-compartment package comprising a container and a bag inside it and having an opening sealed off by a cap with a spray nozzle. The bag collapses when pressure is established between it and the container. Adhesive is applied, prior to insertion of the bag into the container and to pressurization, to the surfaces of essentially cylindrical edges of the container and of the bag that are aligned with the edge of the opening and face each other when the package is used. Once the bag has been inserted into the container, the edge of the bag is spread and forced against the inner surface of the edge of the container by a tool introduced therein. The edges of the container and of the bag are accordingly fastened together tight, and even provided with a bead that can taper toward the opening, by the adhesive. The cap with its nozzle is now placed over the beaded edge. The present invention also concerns a device for carrying out the method.

Such pressurized two-compartment packages and their manufacture are known, from German Patent 3 802 314 for example, which mentions a tool associated with the edge adjacent to the opening but does not specify its design.

The peculiarity of the manufacturing process in question is that the edge of the bag is fastened pressure-tight to the edge of the container, subsequent to which the bag and the container are both deformed until a cap with a nozzle, a spray nozzle for instance, can be fastened pressure-tight to the deformed opening. The bag has always been expanded, to allow the edges to be brought together, by means of plastic tools composed of several parts or segments that together create a tapering central bore. A conical arbor is inserted into the bore, spreading the segments one by one and expanding the tool as a whole. The expansion leaves gaps between the individual segments, allowing the creation of marks in the edge of the bag being expanded. The package can leak. If the outside of the bag has adhesive applied to it in the vicinity of this edge, the surface it is being applied to will be unround, and the adhesive-application heads will be jolted and cannot apply a smooth layer along the circumference. A uniform application of adhesive or uniformly thick layer along the circumference, however, is absolutely essential for the intended tight joint between the edges. Another drawback to plastic tools is the severe thermal stress occasioned by the need to heat the parts of the package during manufacture.

In the past, accordingly, tools of metal, especially steel, have been resorted to, the individual segments secured together by a rubber ring. Such a tool is designed such that the gaps that occur as it expands are occupied by conical sections. The drawback is that the tool is round only at one point along its length, and the diameter cannot be adjusted or corrected.

Furthermore, the gaps are particularly apparent just while the adhesive is being applied, when the tool is only partly open and accordingly unround, which again jolts the applicators. The adhesive will not be applied evenly, producing more marks as it spreads. Such a tool is also very expensive.

SUMMARY OF THE INVENTION

Objects of the present invention are accordingly a simple method of the aforesaid genus and a device for carrying out the method wherein the edges of the bag can be spread absolutely smooth.

The method is attained in accordance with the present invention in that the tool is a resilient piece that can be compressed more or less perpendicular to the plane of the opening, its outside diameter slightly shorter while the bag is being inserted into the container than the inside diameter of the edge of the bag and subsequently increasing constantly and uniformly radially with a continuous circumference against the inner surface of the edge of the inner surface of the edge of the bag, gripping it and laying and forcing, as it expands circumferentially, the outer surface of the edge of the bag against the inner surface of the container, subsequent to which the resilient piece is restored to its original shape in the direction opposite that of its expansion, upon which the tightly sealed totality of bag and container is provided with the beading.

The use of a tool in the form of s resilient piece manipulated in accordance with the present method ensures a smooth spread in that axial compression will produce a smooth radial expansion with a circular area on the part of the resilient piece because the axial deformation will result homogeneously throughout the piece in radial expansion, ensuring that the surface will be circular and continuous.

In one preferred embodiment of the method in accordance with the present invention, the adhesive is applied to the outer surface of the edge of the bag, the bag having been drawn over the arbor that accommodates the resilient piece, the resilient piece is compressed to expand it in an initial expansion phase until its circumference is extensive enough to secure the bag firmly, the bag is rotated around an axis perpendicular to the plane of its opening and the adhesive applied to the outer surface of the edge of the bag, the container is advanced into the ready position, and the resilient piece is expanded farther in another expansion phase, completing the spreading of the edge of the bag, which is accordingly forced against the edge of the container.

Since the expansion is entirely uniform in both phases, the adhesive applicators will, upon completion of the first phase, contact the outer surface of the edge of the now rotating edge entirely without jolting, ensuring smooth application of the adhesive. Since the second phase shares this uniformity, the adhesive-coated outer surface of the edge of the bag will be forced against the facing inner surface of the edge of the container just as smoothly, leaving a totally homogeneous layer of adhesive between the two surfaces all the way around and ensuring a tight joint.

In another preferred embodiment, the edge of the opening in at least the container is tapered outward ahead of time. The container and/or bag can also be preferably heated ahead of time. To ensure uniform expansion of the edge of the bag, the resilient piece can be compressed continuously.

The accordingly tight-bonded edges of the package components can now be further processed at the state of the art.

The device for carrying out the method in accordance with the present invention is characterized by an accommodating arbor, a rod, and a cylindrical resilient piece. The two components—the container and the bag—of the pressurized two-compartment package can be drawn onto the accommodating arbor with the planes of their openings more or less perpendicular to the main axis of the arbor. The rod extends through s longitudinal cutout in the resilient piece, has a radial stop at the end toward the accommodating arbor, and has associated with it an expansion rod. The expansion rod can be displaced along the rod from away from the stop and toward the resilient piece, forcing the resilient piece against the stop. The resilient piece is accordingly axially shortened and radially expanded.

The expansion rod is preferably provided with a longitudinal bore, which the rod extends through. The rods are accordingly coaxial.

In another preferred embodiment, the resilient piece is accommodated between two supports, especially washers, one at each end, that introduce the force of compression into the resilient piece over an extensive area, preferably over the total annular surface of each cylindrical end.

The rod can furthermore be provided with an initial tubular section that extends through the resilient piece and optionally the supports. The accommodating arbor can also preferably have support-and-guidance components rotationally symmetric to the axis of the rod and secured thereto and/or to the initial tubular section of the expansion rod.

Finally, the rod can be provided with a longitudinal bore, and the components that extend beyond the end of the rod can have openings extending toward the bore, creating a blow-off channel that can be pressurized upon termination of spreading and gluing to allow the resulting two-chamber piece to be removed from the accommodating arbor with compressed air aimed at the floor of the bag.

The resilient piece can be a solid cylinder of elastomer, elastomeric plastic, or resilient composite. It can alternatively be a hollow cylinder containing pneumatic, mechanical, or hydraulic means of smoothly expanding it radially.

BRIEF DESCRIPTION OF THE DRAWINGS

The present invention will now be specified with reference to the accompanying drawing, wherein.

DESCRIPTION OF THE PREFERRED EMBODIMENTS

Figures 1, 2:
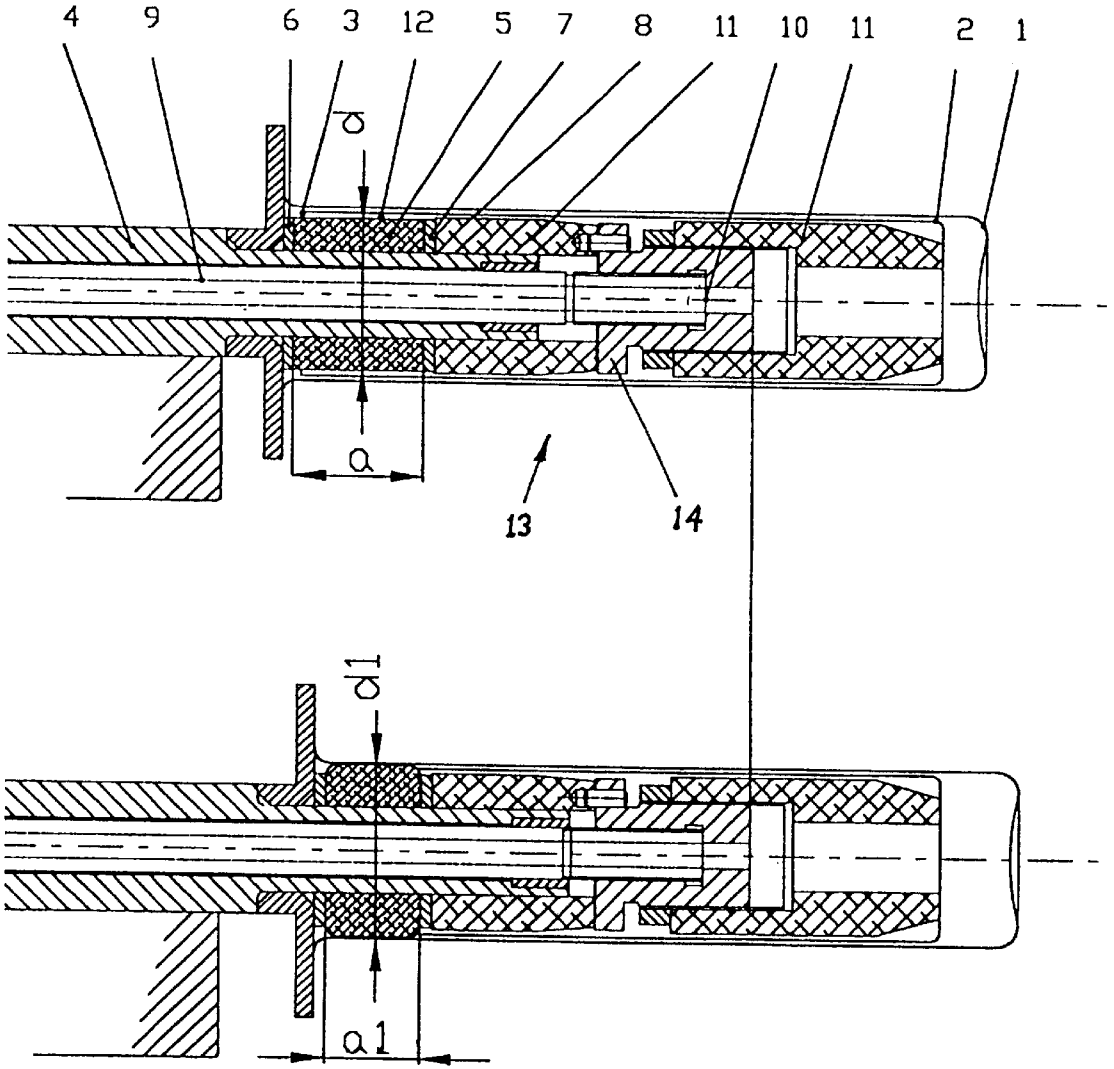
FIG. 1 is a longitudinal section through a pressurized two-compartment package drawn over an accommodating arbor and prior to expansion and FIG. 2 is a longitudinal section similar to that in FIG. 1 but illustrating the situation subsequent to expansion.

An accommodating arbor 13 can be rotated in an unillustrated machine bed. A bag 2 has been drawn, its opening 3 first, over accommodating arbor 13 from the right. Subsequent to an initial but unillustrated expansion phase, during which adhesive is applied, a container is drawn opening-first over the arbor in the same direction, as indicated in the figures. The vicinity of the container's opening has been provided for this purpose with a slight outward taper ("display"). Both container and bag have been heated to approximately 160° C. in a continuous heater.

The accommodating arbor is provided with a rod 9. Rod 9 extends through a resilient piece 5 in the form of a circular cylinder. Screwed onto the free end 10 of rod 9 is a stop 14. Rod 9 has been inserted concentric into a hollow expansion rod 4. Expansion rod 4 constitutes the piston rod of an unillustrated pneumatic, mechanical, or hydraulic piston-and-cylinder mechanism that displaces it back and forth along rod 9. Expansion rod 4 has a tubular initial section that extends into the vicinity of accommodating arbor 13 and operates in conjunction with the central cutout 8 in resilient piece 5 and, at its free end, with the surface of rod 9 by way of a bushing. The resilient piece has a support 6 at one end and another support 7 at the other. Supports 6 and 7 are in the form of washers and almost entirely cover the annular edges of resilient piece 5. The supports distribute the force of compression during expansion and can either be cemented or vulcanized to the ends of resilient piece 5 or just rest against them. The initial section of expansion rod 4 also extends through these washers. Between support 7 and stop 14 is a support-and-guidance component 11 with a longitudinal bore that fits snugly over the end of the initial section of expansion rod 4. Support-and-guidance component 11 is secured to stop 14. Another support-and-guidance component 11 is secured by a longitudinal bore to and rests against a section of the stop that extends beyond the free end 10 of rod 9. Both support-and-guidance components 11 are provided with tapering positioning sections for bag 2 to be drawn over. The end of the latter support-and-guidance component 11 comprises a stop for the floor of the bag as it is drawn into position. The floor of container 1 is concave to allow it to accommodate the pressure exerted by a propellant to be injected later and is provided with an unillustrated intake for a propellant gas to be injected between the inner surface of the container and the outer surface of the bag.

In the situation illustrated in FIG. 1, expansion rod 4 has been retracted toward the machine bed at the left, and resilient piece 5 is uncompressed and exhibits its total length a and diameter d.

In FIG. 2, expansion rod 4 has been displaced to the right in order to spread the edge of the opening 3 in the bag. The cylindrical resilient piece 5, which rests against rod 9 by way of stop 14 and of support-and-guidance component 11 between them is accordingly compressed, diminishing its length from a to a1, which is expressed in a uniform increase in diameter from d to d1. The increase in diameter corresponds to a uniform spread on the part of the edge of the bag, the outer surface of which approaches and is forced against the inner surface of the facing edge of container 1.

To allow adhesive to be applied to the outer surface of the edge of bag 2, an initial spreading phase is carried out before the container is drawn onto the arbor, subsequent to which the outer surface extends slightly beyond the remaining surface of bag 2. In this situation, the interior container cannot slip off the arbor. Spread accordingly, bag 2 is turned by the rotating rods 4 and 9 and brought into contact with unillustrated applicators, which provide it with a smooth layer of adhesive. The adhesive is allowed to dry if necessary and container 1 drawn into the position illustrated in the figures, subsequent to which the second spreading phase is carried out, resulting in the state illustrated in FIG. 2.

Components 1 and 2 are rotationally symmetric, as are the components of the accommodating arbor, to fit.

What is claimed is:

1. A method of manufacturing a pressurized two-compartment package comprising the steps of: providing a container and a bag inside said container and having an opening sealed off by a cap with a spray nozzle; collapsing said bag when pressure is established between said bag and said container; applying adhesive, prior to insertion of said bag into said container and to pressurization, to surfaces of substantially cylindrical edges of the container and of the bag; said edges being aligned with an edge of said opening so that said edges face each other when the package is used; spreading the edge of the bag and forcing the edge of the bag against an inner surface of an edge of the container by a resilient nonheatable tool introduced therein after the bag has been inserted into the container; fastening tight the edges of the container and of the bag; applying a bead to the edges of said container and of said bag; said bead tapering to said opening; placing the adhesive and the cap with the nozzle over the bead; compressing said tool perpendicular to the plane of said opening, said tool having an outside diameter substantially shorter while the bag is being inserted into the container than an inside diameter of the edge of the bag; said outside diameter subsequently increasing constantly and uniformly radially with a continuous circumference against an inner surface of an edge of the inner surface of the edge of the bag; gripping said outside diameter and laying and forcing an outer surface of the edge of the bag against the inner surface of the container as said outside diameter expands circumferentially; restoring thereafter said resilient tool to its original shape in a direction opposite to that of its expansion and forming a tightly sealed bag and container.

2. A method as defined in claim 1, wherein said adhesive is applied to the outer surface of the edge of the bag, said bag having been drawn over an arbor accommodating said resilient tool, said resilient tool being compressed to expand it in an initial expansion phase until its circumference is extensive enough to secure the bag firmly; rotating the bag around an axis perpendicular to a plane of its opening and applying the adhesive to the outer surface of the edge of the bag; advancing the container into a ready position; expanding said resilient tool farther in another expansion phase; and completing spreading of the edge of the bag and forcing the edge of the bag against the edge of the container.

3. A method as defined in claim 1, wherein the edge of the opening in at least the container is tapered outward ahead of time.

4. A method as defined in claim 1, wherein said container and bag are preheated.

5. A method as defined in claim 1, wherein said resilient tool is compressed continuously.

* * * * *